United States Patent [19]

Bourne, Jr. et al.

[11] 4,226,555

[45] Oct. 7, 1980

[54] MOORING SYSTEM FOR TENSION LEG PLATFORM

[75] Inventors: Henry A. Bourne, Jr.; Mamdouh Salama, both of Ponca City, Okla.

[73] Assignee: Conoco, Inc., Ponca City, Okla.

[21] Appl. No.: 967,653

[22] Filed: Dec. 8, 1978

[51] Int. Cl.[2] ..... E02B 17/00; B63B 35/44

[52] U.S. Cl. ..... 405/224; 405/204; 114/264; 166/338

[58] Field of Search ..... 405/224, 225, 226, 227, 405/195-209; 166/338, 339, 340, 342, 343, 344, 345, 341, 348; 175/5-7; 114/264, 265, 294

[56] References Cited

U.S. PATENT DOCUMENTS

| | | | |
|---|---|---|---|
| 2,906,100 | 9/1959 | DeLong et al. | 405/224 X |
| 2,931,184 | 4/1960 | D'Arcangelo | 405/224 |
| 3,330,338 | 7/1967 | Dozier | 405/224 X |
| 3,355,899 | 12/1967 | Koonce et al. | 405/202 |
| 3,361,200 | 1/1968 | Chambers | 166/348 X |
| 3,618,661 | 11/1971 | Peterman . | |
| 3,648,638 | 3/1972 | Blenkarn . | |
| 3,934,528 | 1/1976 | Horton et al. | 405/224 X |
| 3,976,021 | 8/1976 | Blenkarn et al. . | |
| 4,062,313 | 12/1977 | Stram | 405/224 X |
| 4,070,869 | 1/1978 | Williams | 405/225 |

*Primary Examiner*—Dennis L. Taylor

*Attorney, Agent, or Firm*—A. Joe Reinert

[57] ABSTRACT

The present invention provides methods and apparatus for mooring a tension leg platform. The platform is positioned over an anchor means attached to the ocean floor. A plurality of guidelines or cables, attached to the anchor means, are called to the surface by means of acoustic recall buoys which are attached to a free end of the guide cables. The guide cables are then connected to the floating platform. Tension legs, each including a plurality of tubular leg elements threaded at each end, with threaded couplings connecting adjacent leg elements, are then lowered from the floating platform. Guide means connected between the tension legs and the guide cables direct the tension legs toward the anchor means on the ocean floor. A hydraulically actuated wellhead connector is connected to a lower end of the tension leg. The wellhead connector engages a wellhead body attached to the anchor means, and is locked thereto upon the sending of a hydraulic signal to the wellhead connector. The hydraulic signal is directed to the wellhead connector through the tubular tension leg. After the tension legs are connected between the anchor means and the floating platform, the floating platform is deballasted to apply a tensile load to the tension legs.

30 Claims, 8 Drawing Figures

MOORING SYSTEM FOR TENSION LEG PLATFORM

BACKGROUND OF THE INVENTION

1. Field of the Invention

This invention relates generally to tension leg platforms for offshore drilling operations, and more particularly, but not by way of limitation, to mooring systems for tension leg platforms having a plurality of tension legs comprised of threaded tubular leg elements.

2. Description of the Prior Art (Prior Art Statement)

The following statement is intended to be a prior art statement in compliance with the guidance and requirements of 37 C.F.R. §§1.56, 1.97 and 1.98.

In deep water, e.g. five hundred feet or more, the use of bottom-founded steel or concrete structures for oil well drilling and production operations becomes quite expensive due to the high cost of fabrication and installation of such large structures. A more economical solution to the problem of providing a suitable semi-permanent site for drilling and producing operations in deep water is the use of a floating structure which is moored to fixed sea floor anchor points with vertical tension legs. Such a structure is known as a tension leg platform.

The use of pretensioned vertical mooring elements prevents vertical motion or heave of the floating structure during the passage of waves, but does permit lateral motions. The pretensioning, which is accomplished by deballasting the floating structure after the tension legs have been connected between the floating structure and fixed sea floor anchor bases, prevents the tension legs from becoming slack during passage of the troughs of waves associated with extreme environmental conditions.

The prior art discloses several systems for mooring such a tension leg platform. U.S. Pat. No. 3,648,638 to Blenkarn discloses a tension leg platform having a plurality of tubular tension legs. The tension legs of the Blenkarn apparatus are of very large diameter, from twenty to thirty inches. Those tension legs do not include a plurality of tubular tension leg elements having threaded ends. Also, the Blenkarn apparatus does not disclose anything similar to either the upper and lower connecting means or the methods of mooring of the present invention.

U.S. Pat. No. 3,976,021 to Blenkarn et al. discloses a method of installation of a tension leg platform like that of U.S. Pat. No. 3,648,638. In that method, however, the tension legs are installed in a manner very different from the methods of the present invention. In Blenkarn et al., an ocean floor anchor means is lowered from the floating platform by a plurality of guidelines. Large riser pipes, having a diameter of twenty inches or greater, are then connected between the anchor and the floating vessel and then placed under tension. Those riser pipes do not include the threaded leg elements of the present invention. Also, those riser pipes do not include anything similar to the connecting means at the upper and lower ends of the tension leg of the present invention. The methods of placing the tension legs between the floating platform and the sea floor anchor means are considerably different in the present invention as will be apparent from the following disclosure.

U.S. Pat. No. 3,355,899 to Koonce et al. discloses another method of anchoring a floating vessel. In the Koonce et al. method guidelines attached to the sea floor anchor are threaded through tubular tension legs of a combined tension leg structure which is initially located upon a barge or other floating vessel. The tension leg structure is then lowered, as a complete assembly, from the floating vessel and guided to the anchor means by the guidelines which had been threaded through the tension legs. Koonce et al. does not disclose the threaded tension legs of the present invention nor the methods of installing the same.

U.S. Pat. No. 3,618,661 to Peterman discloses a number of different guide means for connection between a drill string and a plurality of guide cables to guide the drill string toward a specific location on a sea floor anchor means.

Because these floating structures must remain in place throughout the productive life of the sub-sea oil field, and must withstand the environmental loadings expected during this time period, it is essential that the vertical mooring system components be reliable, inspectable and replaceable if need be. These requirements, first of all, demand redundancy in regard to the number of tension legs. Other desirable objectives in the selection of vertical mooring elements or tension legs are that they can be installed using onboard equipment carried on the tension leg platform, without the need of expensive derrick barges or other specialized service vessels.

These requirements are met by the methods and apparatus of the present invention which provide multiple, redundant tension legs for a tension leg platform, each tension leg consisting of individual threaded steel tubular tension leg elements which can be readily installed, retrieved for inspection, and replaced if necessary, using equipment onboard the tension leg platform.

SUMMARY OF THE INVENTION

The present invention provides methods and apparatus for mooring a tension leg platform. The platform is positioned over an anchor means attached to the ocean floor. A plurality of guidelines or cables, attached to the anchor means, are called to the surface by means of acoustic recall buoys which are attached to a free end of the guide cables. The guide cables are then connected to the floating platform. Tension legs, each including a plurality of tubular leg elements threaded at each end, with threaded couplings connecting adjacent leg elements, are then lowered from the floating platform. Guide means connected between the tension legs and the guide cables direct the tension legs toward the anchor means on the ocean floor. A hydraulically actuated wellhead connector is connected to a lower end of the tension leg. The wellhead connector engages a wellhead body attached to the anchor means, and is locked thereto upon the sending of a hydraulic signal to the wellhead connector. The hydraulic signal is directed to the wellhead connector through the tubular tension leg. After the tension legs are connected between the anchor means and the floating platform, the floating platform is deballasted to apply a tensile load to the tension legs.

It is, therefore, a general object of the present invention to provide improved methods and apparatus for mooring floating vessels.

Another object of the present invention is the provision of an improved tension leg platform.

Yet another object of the present invention is the provision of an improved tension leg for tension leg platforms.

A further object of the present invention is the provision of a tension leg comprised of a plurality of tubular threaded tension leg elements.

Yet a further object of the present invention is the provision of a tension leg mooring system having a hydraulically actuated locking means on a lower end of the tension leg, said locking means being actuated by a hydraulic signal directed through the tubular tension leg.

Still another object of the present invention is the provision of apparatus and methods for mooring a tension leg platform without the need for sending divers to the bottom of the ocean floor.

Other and further objects, features and advantages of the present invention will be readily apparent to those skilled in the art upon a reading of the description of the preferred embodiments which follows when taken in conjunction with the accompanying drawings.

DETAILED DESCRIPTION OF THE PREFERRED EMBODIMENTS

Figure 1:
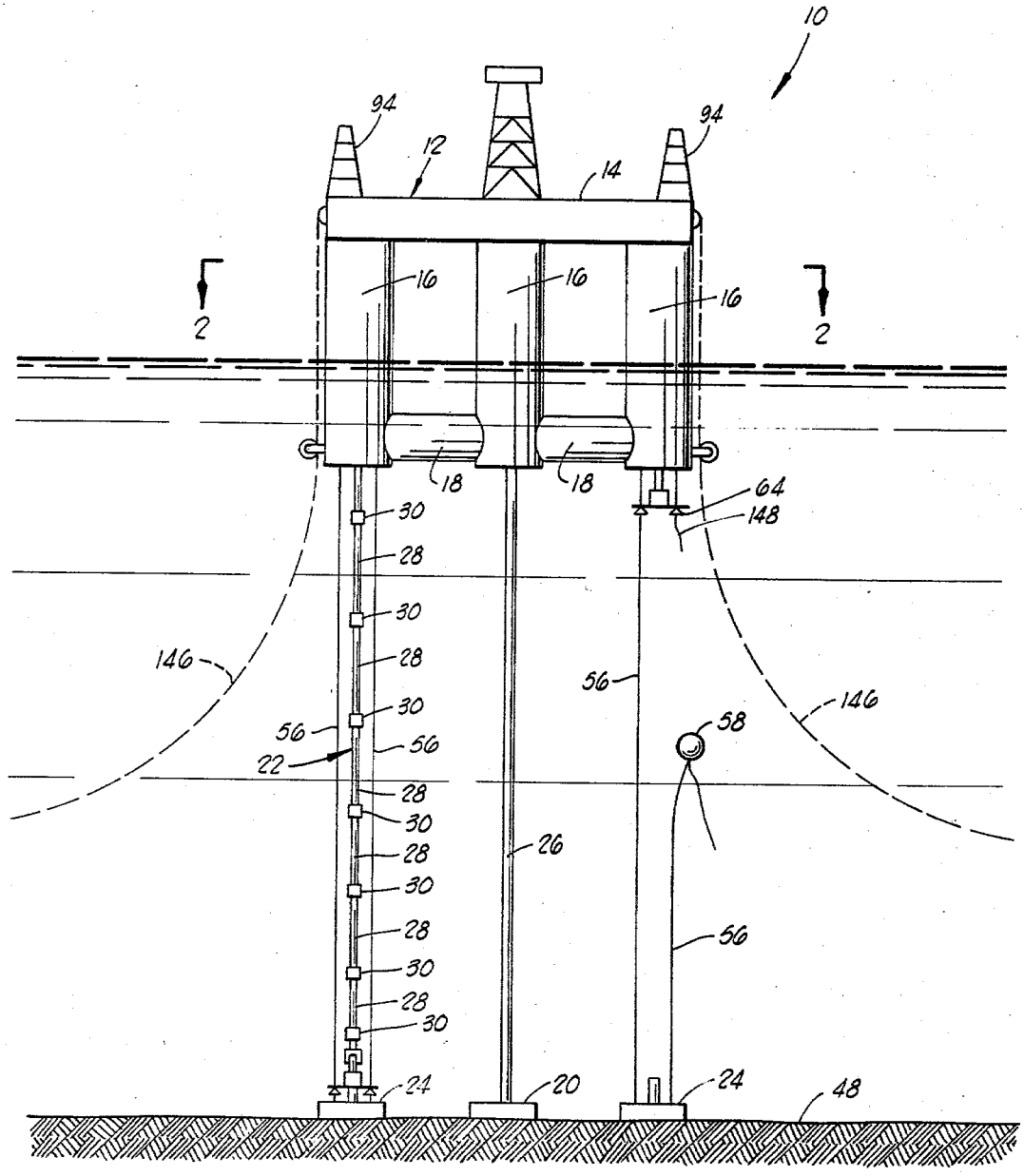
FIG. 1 is an elevational schematic view showing a floating platform in place over a sea floor anchor means. The left side of FIG. 1 illustrates a tension leg already installed between the floating platform and the sea floor anchor. The right side of FIG. 1 illustrates the procedure of connecting the guide cables so that a tension leg may be lowered to the sea floor anchor means.

Referring now to the drawings and particularly to FIG. 1, the mooring system of the present invention is shown and generally designated by the numeral 10.

A tension leg platform 12 includes a deck portion 14, six vertical cylindrical sections 16, and lower horizontal pontoon portions 18 interconnecting the lower ends of the vertical, cylindrical sections 16.

Tension leg platform 12 is retained in position, over a sea floor drilling template 20, by twelve vertical tension legs 22 which are attached at their lower ends to one of four sea floor anchor templates 24.

A drill string 26 is used to drill oil well boreholes (not shown) in the ocean floor through drilling template 20 as will be understood by those skilled in the art.

Figure 3:
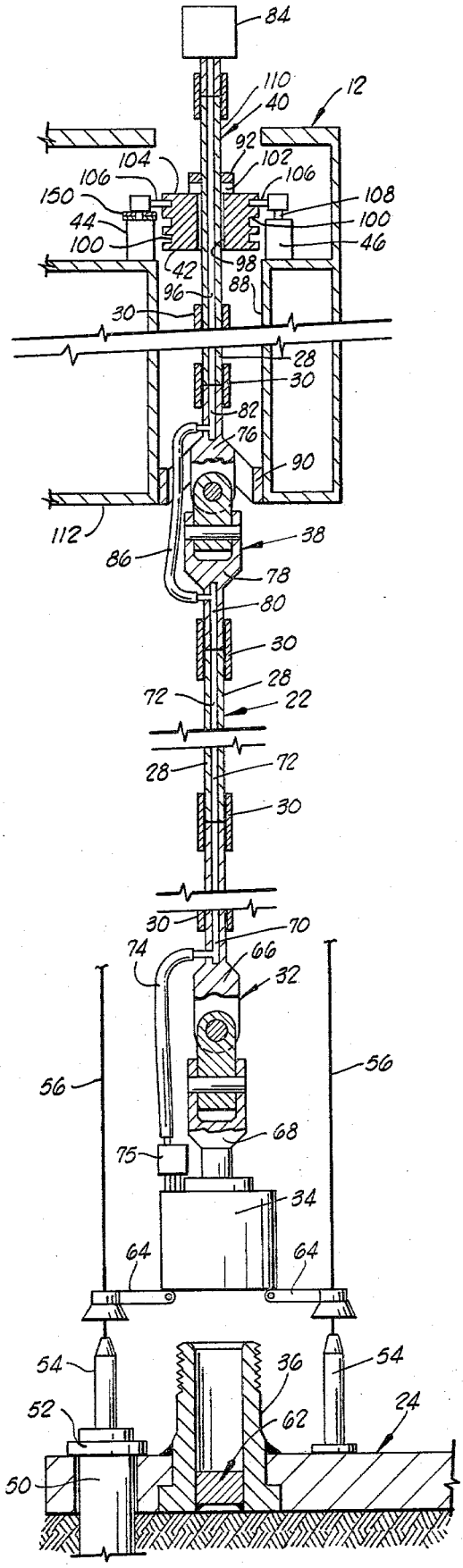
FIG. 3 is an elevational section view of the floating platform, a tension leg of the present invention and a sea floor anchor means.

Referring now to FIG. 3, the details of construction of these components are more clearly shown. Each of the tension legs 22 includes a plurality of threaded hollow steel tubular tension leg elements 28 interconnected by threaded couplings 30.

Each tension leg 22 is connected to one of the sea floor anchor templates 24 by a lower flexible connection 32 and a remotely actuated hydraulic connector cap 34, which preferably is a standard wellhead connector. Wellhead connector 34 is hydraulically actuated to lock onto hydraulic connector base 36 which preferably is a standard wellhead body. Connector base 36 and cap 34 may be described as first and second connector portions, respectively.

An upper tension leg element 28 of each tension leg 22 is connected to an upper flexible connection 38 which is connected to a hanger means 40. Hanger means 40 is supported by a tension frame 42, which itself is supported from platform 12 by first and second hydraulic rams 44 and 46. Rams 44 and 46 provide a tension frame adjusting means connected between platform 12 and tension frame 42.

The details of construction of these various components will now be described.

Figure 4:
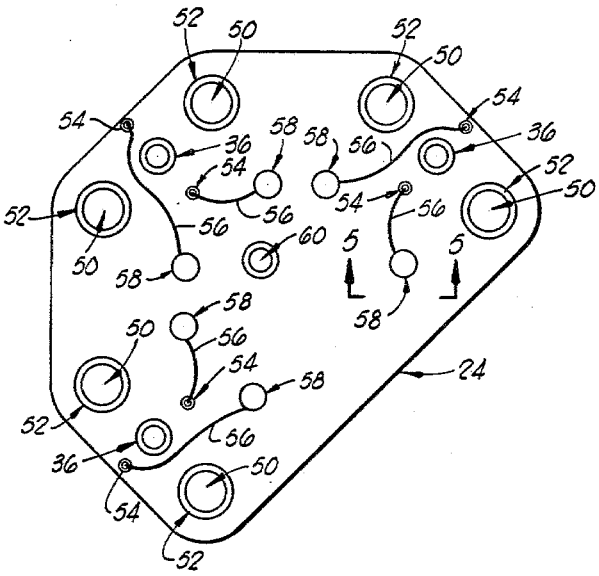
FIG. 4 is a plan view of a sea floor anchor template.

A plan view of one of the sea floor anchor templates 24 is shown in FIG. 4. Anchor template 24 is fixed in position on the ocean floor 48 by six steel pilings 50 which penetrate into the soil below the ocean floor. Sea floor anchor template 24 is retained in place about pilings 50 by pile collars 52.

Figure 5:
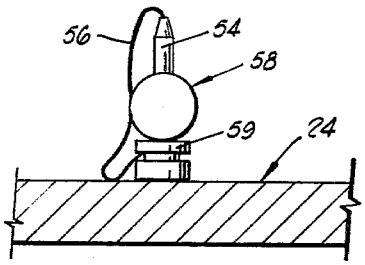
FIG. 5 is an elevation view of an acoustic recall buoy of the anchor template, taken along line 5—5 of FIG. 4.

As is best seen in FIG. 4, a standard wellhead body 36 is located between each pair of piles 50. A pair of guideposts 54 are attached to anchor template 24 adjacent each wellhead body 36 on opposite sides thereof. Attached to each guidepost 54 is a guideline or guide cable 56 having an acoustic recall buoy 58 attached to a free end thereof. Each buoy 58 is connected to recall buoy releasing means 59 (see FIG. 5). The purpose of guidelines 56, as will be further explained below, is to direct tension leg 22 toward anchor template 24 as the tension leg 22 is lowered from platform 12, and to align standard wellhead connector 34 with standard wellhead body 36, before the connector 34 slips over the body and is locked thereto.

The purpose of the acoustic recall buoys 58 is to bring individual guidelines 56 to the ocean surface when the buoys are released in response to the reception of a coded acoustical command transmitted from the ocean surface. The use of acoustical buoys 58 obviates the need for using divers to attach guidelines 56 to the guide posts 54 after the sea floor anchorage template 24 is in place on the ocean floor 48 and secured in position with the pilings 50.

Anchor template 24 is also equipped with an additional standard wellhead body 60, located at the center of gravity of sea floor anchor template 24. This additional wellhead body 60 is provided for handling purposes and is only used during placement of the sea floor anchor templates 24 on the ocean floor 48.

Standard wellhead body 36 includes a plug 62 welded in place therein, to seal off the lower end of the wellhead body 36 as is seen in FIG. 3.

Standard wellhead connector 34 has two foldable guide means 64 attached thereto, which engage guidelines 56.

The lower flexible connection 32 includes an upper portion 66 and a lower portion 68. Hydraulic connector cap 34 is attached to the lower portion 68. Upper portion 66 includes a conduit means 70 communicating with an inner cavity 72 of tension leg 22. A lower hydraulic connecting hose 74 connects conduit means 70 with hydraulic sequence valve 75. Valve 75 is an actuating valve which causes connector 34 to lock onto wellhead body 36.

Upper flexible connection 38 includes an upper portion 76 and a lower portion 78. The lower portion 78 is connected to tension leg 22.

Lower portion 78 includes a conduit means 80, communicating with inner cavity 72 of an upper tubular leg element 28 of tension leg 22. Upper portion 76 includes a conduit means 82, communicating with a source 84 of a hydraulic actuating signal. An upper hydraulic connecting hose 86 communicates conduit means 80 and 82. Hoses 74 and 86 may generally be referred to as hydraulic connnectors.

Figure 2:
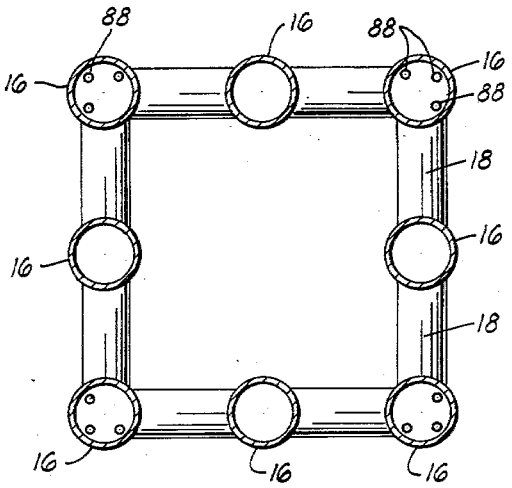
FIG. 2 is a section view of the floating platform taken along line 2—2 of FIG. 1.

Upper portion 76 of upper flexible connection 38 is disposed in a vertical cylindrical shaft 88 of tension leg platform 12. As is shown in FIG. 2, the shafts 88 are located in the four corner vertical sections 16 of platform 12. Spacing of the shafts 88 corresponds to the spacing of wellhead bodies 36 on anchor template 24.

Upper portion 76 includes a centralizer collar 90, concentrically received in said shaft 88, to position said upper portion 76 centrally in said shaft 88. Upper portion 76 of upper flexible connection 38 is attached to hanger means 40 by additional threaded tubular elements 28 and couplings 30.

Hanger means 40 is a tubular structure threaded at each end, and having a shoulder 92 projecting radially outward from a central portion of the hanger means. Hanger means 40 is initially connected to derrick 94 which provides a means for lowering the tension leg 22. Derrick 94 is equipped with conventional hoisting equipment (not shown). An inner cavity 96 of hanger means 40 provides hydraulic communication between conduit means 82, of upper portion 76 of upper flexible connection 38, and source 84.

Tension frame 42 is a rectangular cross-section structure having an axia bore 98 therethrough, within which tubular hanger means 40 is received. Tension frame 42 includes a plurality of radially outer vertically spaced pin-receiving sockets 100.

A load cell 102 engages a lower surface of shoulder 92 and an upper surface 104 of tension frame 42, thereby supporting shoulder 92 from tension frame 42.

The hydraulic rams 44 and 46, which are attached at one end to platform 12, include extendable pins 106 which extend from piston assemblies 108 to engage the sockets 100 of tension frame 42.

The hydraulic rams 44 and 46 provide a means for raising tension frame 42, relative to platform 12, so as to transfer the tensile load of tension leg 22 from an upper end 110 of hanger means 40 to hydraulic rams 44 and 46.

A bottom portion 112 of platform 12, illustrated in FIG. 3, represents a bottom portion of one of the vertical cylindrical sections 16.

Figure 6:
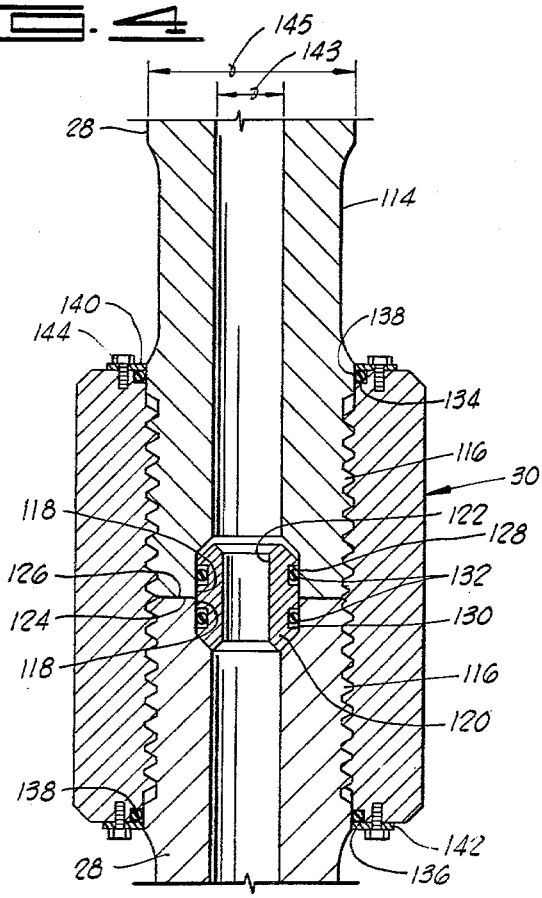
FIG. 6 is a detailed elevational section view of the threaded ends of two adjacent tubular tension leg elements connected by a threaded coupling.

Referring now to FIG. 6, the details of the threaded and coupled connections, between adjacent tension leg elements 28 of tension leg 22, are shown.

Each of the threaded hollow tubular tension leg elements 28 are of a convenient length of approximately thirty feet. Each of those elements 22 has a turned down section 114 at each end for handling purposes and to provide stress relief.

At each end of tubular leg elements 28 there is an axial counterbore 118. An internal cylindrical plug 120, having an axial bore 122 therethrough, is received in counterbores 118 of first and second abutting tubular leg element ends 124 and 126.

Cylindrical plug 120 includes first and second annular grooves 128 and 130, respectively, which have resilient sealing means 132 disposed therein.

Coupling 30 is internally threaded and includes upper and lower axial counterbores 134 and 136, respectively, which form annular grooves for receiving annular sealing rings 138. Sealing rings 138 seal between coupling 30 and tubular leg elements 28. Upper and lower split annular plates 140 and 142 are connected to coupling 30 by cap screws 144, and serve to retain sealing rings 138 in counterbores 134 and 136.

The threads on leg elements 28 and cap 30 are straight 60°, included angle, Acme threads which allow the ends 124 and 126 to come into contact. Leg element 28 has an inner diameter 143 of three inches, and an outer diameter 145 of nine inches.

Figure 7:
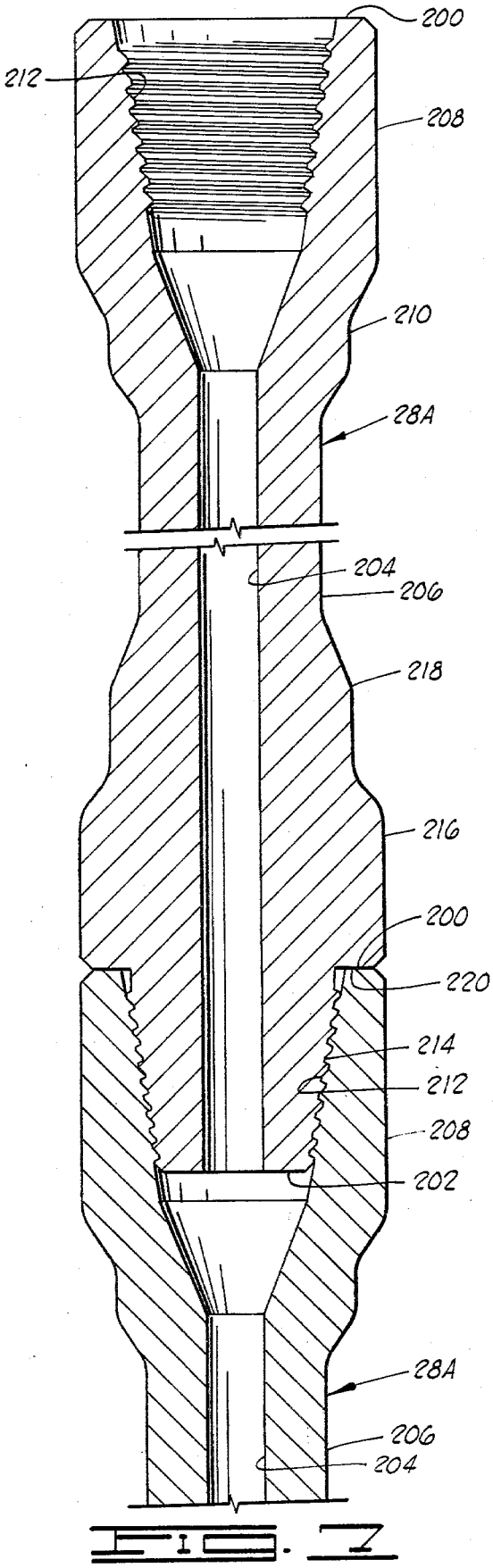
FIG. 7 is a sectional elevation view of an alternative form of tension leg element having threaded male and female ends.

Referring now to FIG. 7, an alternative form of tension leg element is shown and generally designated by the numeral 28A. Tension leg element 28A includes an upper end 200 and a lower end 202, and has a bore 204 therethrough. Upper and lower ends 200 and 202 are threaded as is further described below.

Tension leg element 28A includes a cylindrical outer surface 206. Near upper end 200 is an increased outer diameter portion 208, which is connected to cylindrical surface 206 by irregularly tapered portion 210.

A tapered internally threaded box connection 212 communicates with upper end 200 and bore 204.

Near lower end 202 of tension leg element 28A is a tapered externally threaded pin connection 214. Adjacent pin connection 214 is a lower enlarged outer diameter portion 216 connected to cylindrical surface 206 by lower irregularly tapered portion 218. An annular downward facing shoulder 220 connects pin 214 and lower enlarged diameter 216.

Lower end 202 is shown in FIG. 7 connected to an upper end 200 of a second tension leg element 28A. The pin connection 214 and box connection 216 of adjacent tension leg elements 28A are made up so that upper end 200, of the lower tension leg element 28A, engages downward facing shoulder 220 of the upper tension leg element 28A.

Figure 8:
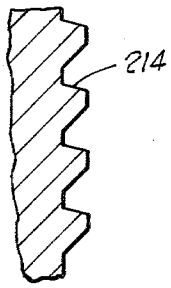
FIG. 8 is an enlarged detail view of the threads of the tension leg element of FIG. 7.

The threads of pin 214 and box 212 are preferably modified Buttress threads having a configuration similar to that shown in FIG. 8, with a 1/32 inch radius at all corners. Preferably, pin 214 and box 212 are torqued together very tightly to help avoid fatigue failure at the connections. This design also provides a mechanical seal at the point of engagement of upper end 200 with shoulder 220, thereby avoiding the need for resilient seals between tension leg elements 28A.

METHOD OF MOORING

The method of mooring the floating platform 12, according to the present invention, is as follows. The platform 12 is typically towed to the installation site by tugboats (not shown). The tugboats are used to set four conventional anchors (not shown) of a conventional four-point catenary mooring system on the platform 12. The platform 12 is then positioned over sea floor anchor bases 24 by adjusting the lengths of mooring lines 146.

An acoustical signal is then transmitted causing acoustical recall buoys to rise, one at a time, bringing guidelines 56 to the surface. Divers then attach the guidelines 56 to prepositioned messenger lines 148 which extend from a lower end of vertical shaft 88. As is seen in FIG. 1, messenger lines 148 are threaded through guide means 64 of wellhead connector 34.

After the guidelines 56 are connected to messenger lines 148, the guidelines 56 are tensioned.

Then tension leg 22 is lowered from platform 12. This is done by lowering a lower tubular leg element 28, having the lower flexible connection 32 and lower wellhead connector 34 attached thereto, from one of the derricks 94. As each tubular leg element 28 is lowered, another tubular leg element 28 is connected thereto with a coupling 30. (When using the alternative tension leg elements 28A of FIG. 7, the pin 214 and box 212 of adjacent tension leg elements 28A are made up together.) Then, that leg element is lowered and another successive tubular leg element is connected, and so on, until wellhead connector 34 engages wellhead body 36.

An upper tubular leg element 28 is connected to upper flexible connection 38, which is connected to hanger means 40, which is suspended from derrick 94 by additional threaded and coupled tubular elements as necessary (not shown).

A hydraulic fluid under pressure, i.e., a hydraulic actuating signal, from source 84, is then directed or communicated through a hydraulic conduit means including conduit 96, conduit 82, upper connector hose 86, conduit 80, inner cavity 72 of tension leg 22, conduit 70 and lower connector hose 74 to hydraulic sequence valve 75 atop wellhead connector 34 to cause connector 34 to lock onto wellhead body 36.

After all twelve tension legs 22 have been locked to anchor bases 24, the tension frames 42 are raised to engage load cells 102 and to raise tension legs 22, relative to platform 12, to remove the weight of tension legs 22 from the derrick 94. Shims 150 are then placed under pistons 108 to fix their position relative to the cylinders of rams 44 and 46.

Tension frame 42 is raised by inserting extendable pins 106 into sockets 100, and then supplying hydraulic fluid under pressure to rams 44 and 46 so as to extend pistons 108.

When all twelve tension legs 22 have been so adjusted, tension leg platform 12 is deballasted by pumping water from the ballast tanks (not shown). This results in the development of a pretension load in the tension legs 22.

The tension leg platform 12 is now installed and ready for use. When it is desired to retrieve and inspect one of the tension legs 22, this is easily accomplished by reversing the installation procedure.

Thus, the methods and apparatus for mooring tension leg platforms of the present invention are well adapted to carry out the objects and attain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

The embodiments of the invention in which an exclusive property or privilege is claimed are defined as follows:

1. A mooring system for a tension leg platform, comprising:

a tension leg, including a plurality of tubular leg elements having threaded connections between adjacent leg elements;

a means for connecting an upper end of said tension leg to said tension leg platform;

a means for connecting a lower end of said tension leg to an anchor means connected to the ocean floor, said lower end connecting means being hydraulically actuated; and a means for communicating a hydraulic actuating signal from said tension leg platform to said lower end connecting means, said communicating means including an inner cavity of said tension leg.

2. Apparatus of claim 1, wherein said upper end connecting means comprises:

a flexible connection having an upper portion connected to said tension leg platform and a lower portion connected to said tension leg, said lower portion including a first conduit means communicating with an inner cavity of an upper tubular leg element, and said upper portion including a second conduit means communicating with a source of said actuating signal, and said upper end connecting means further including a hydraulic connector communicating said first and second conduit means.

3. Apparatus of claim 2, wherein said upper end connecting means further comprises:

a tubular hanger, having a shoulder projecting radially outward therefrom, said hanger having a lower end connected to said upper portion of said flexible connection, and having an inner cavity providing hydraulic communication between said second conduit means and said source of said actuating signal;

a tension frame;

a load cell, engaging a lower surface of said radially extending shoulder and an upper surface of said tension frame; and frame adjusting means, connected between said tension frame and said tension leg platform, for raising said tension frame relative to said tension leg platform to transfer the tensile load of said tension leg from an upper end of said tubular hanger to said frame adjusting means.

4. Apparatus of claim 3, wherein said frame adjusting means includes a hydraulic jack.

5. Apparatus of claim 4, wherein:

said tension frame has disposed therein a plurality of vertically spaced pin-receiving sockets; and said frame adjusting means further includes an extendable pin, connected to a piston assembly of said jack, said pin being constructed for engagement with one of said pin-receiving sockets.

6. Apparatus of claim 2, wherein:

said upper end connecting means is disposed in a vertical cylindrical shaft of said tension leg platform; and said upper portion of said flexible connection includes a centralizer collar, concentrically received in said shaft, to position said upper portion centrally in said shaft.

7. Apparatus of claim 2, wherein said lower end connecting means comprises:

a second flexible connection having an upper portion connected to said tension leg and a lower portion connected to a hydraulic connector cap, said cap being constructed for engagement with a hydraulic connector base attached to said anchor means, said upper portion including a third conduit means communicating with an inner cavity of a lower tubular leg element, and said lower end connecting means further including a second hydraulic connector communicating said third conduit means with an actuating valve connected to said hydraulic connector cap.

8. Apparatus of claim 7, wherein:

said hydraulic connector cap is a wellhead connector; and said hydraulic connector base is a wellhead body.

9. Apparatus of claim 1, wherein said lower end connecting means comprises:

a flexible connection having an upper portion connected to said tension leg and a lower portion connected to a hydraulic connector cap, said cap being constructed for engagement with a hydraulic connector base attached to said anchor, said upper portion including a conduit means communicating with an inner cavity of a lower tubular leg element, and said lower end connecting means further including a hydraulic connector communicating said conduit means with an actuating valve connected to said hydraulic connector cap.

10. Apparatus of claim 9, wherein:

said hydraulic connector cap is a wellhead connector; and said hydraulic connector base is a wellhead body.

11. Apparatus of claim 1, wherein:

said tension leg is further characterized in that said tubular leg elements are threaded at each end and said tension leg includes threaded couplings connecting adjacent leg elements; and said tubular leg elements have a turned down portion adjacent each threaded end.

12. Apparatus of claim 1, wherein:

said tension leg is further characterized in that said tubular leg elements are threaded at each end and said tension leg includes threaded couplings connecting adjacent leg elements;

the ends of said tubular leg elements include axial counterbores; and an internal cylindrical plug, having an axial bore therethrough, is received in the axial counterbores of first and second abutting tubular leg element ends.

13. Apparatus of claim 12, further comprising:

first and second annular seals, sealingly engaging said plug and said axial counterbores of said first and second abutting ends, respectively.

14. Apparatus of claim 12, wherein:

said couplings are internally threaded and include upper and lower axial counterbores having resilient sealing rings disposed therein, one of said rings sealingly engaging each of said adjacent leg elements, with upper and lower annular plates connected to upper and lower ends of said couplings to retain said sealing rings in said counterbores.

15. Apparatus of claim 1, wherein:

said tubular leg elements include an externally threaded pin connection at a first end and an internally threaded box connection at a second end, with a pin connection of a first leg element being made up with a box connection of an adjacent second leg element.

16. Apparatus of claim 15, wherein:

said second end of said second leg element is engaged with a downward facing annular shoulder of said first end of said first leg element to form a mechanical seal between said first and second leg elements.

17. Apparatus for mooring a floating platform in a body of water, said apparatus comprising:

an anchor means attached to a floor of said body of water, said anchor having a guideline attached thereto, said guideline having a buoy attached to a free end thereof;

a means for releasing said buoy, in response to a signal from said platform, so that said buoy may rise from said anchor and carry said free end of said cable to said platform to be connected thereto;

a tension leg, including a plurality of hollow leg elements, having threaded connections between adjacent leg elements;

a means for lowering said tension leg from said platform;

a means for connecting a lower end of said tension leg to said anchor means, said lower end connecting means being actuated by a fluid pressure signal; and guide means, connected between said tension leg and said guide cable, so that said lower end of said tension leg is guided towards said anchor as it is lowered from said platform.

18. Apparatus of claim 17, wherein:

said connecting means includes a connector base attached to said anchor means, and a connector cap connected to said tension leg, said connector cap being hydraulically actuated to lock onto said connector base; and said apparatus further includes a means for connecting an inner cavity of said leg to a source of fluid under pressure and a means for connecting said inner cavity of said leg to an actuating means connected to said connector cap to supply said fluid under pressure to said actuating means.

19. Apparatus of claim 18, wherein:

said connector cap is a wellhead connector; and connector base is a wellhead body.

20. Apparatus of claim 17, wherein said platform has a vertical shaft disposed therein through which said tension leg is lowered, and said apparatus further comprises:

a flexible joint attached to an upper hollow leg element of said tension leg;

a hanger means connected to said flexible joint;

a tension frame engaging said hanger means; and a tension frame adjusting means, connected between said platform and said tension frame, for adjusting the position of said tension frame vertically relative to said platform, so that said tension leg may be raised relative to said platform, after said tension leg is connected to said anchor means, to transfer the weight of said tension leg to said frame adjusting means.

21. Apparatus of claim 20, wherein:

said hanger means includes a radially projecting shoulder;

said tension frame supports a lower surface of said shoulder; and said frame adjusting means includes an extendable pin for engagement with said tension frame.

22. Apparatus of claim 21, wherein:

said frame adjusting means comprises a hydraulic ram.

23. A method of mooring a tension leg platform in a body of water, said method comprising the steps of:

positioning said platform over an anchor means attached to a floor of said body of water, said anchor means having a first remotely actuated connector portion attached thereto;

connecting a guideline between said platform and said anchor means;

lowering a hollow tension leg from said platform, said tension leg including guide means engaging said guideline, until a second connector portion connected to said tension leg engages said first connector portion;

directing a fluid under pressure, through said hollow tension leg, to said first connector portion to connect said first and second connector portions; and deballasting said platform to apply a tensile load to said tension leg.

24. Method of claim 23, wherein said guideline has a first end connected to said anchor means and a second end connected to an acoustic recall buoy, and said step of connecting a guideline comprises:

transmitting an acoustic signal to cause said recall buoy to rise and carry said guideline toward a surface of said body of water; and connecting said guideline to said platform.

25. Method of claim 23, wherein said step of lowering said tension leg comprises:

a. lowering a first tubular leg element, having threaded ends, from said platform;

b. connecting said first leg element to a second leg element;

c. lowering said second tubular leg element from said platform; and d. repeating steps b and c with successive leg elements until said second connector portion engages said first connector portion.

26. Method of claim 25, wherein said step of lowering said tension leg further comprises:

connecting an upper tubular leg element to a flexible joint having upper and lower joint portions, said upper and lower joint portions having cavities therein, said lower joint cavity communicating with an inner cavity of said upper tubular leg element, and said upper and lower joint cavities being in fluid communication; and connecting said upper joint cavity to a source of fluid under pressure.

27. Method of claim 25, wherein:

said step of lowering said tension leg is further characterized as lowering said tension leg, from a derrick attached to said platform, through a vertical shaft disposed in said platform; and said method further includes the step of raising said tension leg, relative to said platform, to remove the weight of said tension leg from said derrick.

28. Method of claim 27, wherein said step of raising comprises:

placing a tension frame about said tension leg to support a radially projecting shoulder thereof;

extending an extendable pin, connected to a piston assembly of a hydraulic cylinder connected to said platform, into a pinreceiving socket in said tension frame; and applying hydraulic pressure to said cylinder to raise said tension leg.

29. Method of claim 25, further comprising:

lowering a plurality of additional tension legs from said platform to said anchor means.

30. Method of claim 25, wherein said first connector portion is a wellhead connector body and said second connector portion is a wellhead cap.

* * * * *